US011389874B1

(12) United States Patent
Jorjadze et al.

(10) Patent No.: US 11,389,874 B1
(45) **Date of Patent: *Jul. 19, 2022**

(54) SYSTEMS AND METHOD FOR THE PRODUCTION OF SUBMICRON SIZED PARTICLES

(71) Applicants: Vasily Jorjadze, Shoreham, NY (US); David Gelenidze, Tbilisi (GE)

(72) Inventors: Vasily Jorjadze, Shoreham, NY (US); David Gelenidze, Tbilisi (GE)

( * ) Notice: Subject to any disclaimer, the term of this patent is extended or adjusted under 35 U.S.C. 154(b) by 0 days.

This patent is subject to a terminal disclaimer.

(21) Appl. No.: 17/562,285

(22) Filed: Dec. 27, 2021

Related U.S. Application Data

(63) Continuation-in-part of application No. 17/174,545, filed on Feb. 12, 2021, now Pat. No. 11,242,605.

(51) Int. Cl.

| | |
|---|---|
| ***B22F 9/12*** | (2006.01) |
| ***F27D 11/02*** | (2006.01) |
| ***F27B 17/00*** | (2006.01) |
| ***B22F 1/054*** | (2022.01) |
| ***F27D 19/00*** | (2006.01) |

(52) U.S. Cl.
CPC ..... *B22F 9/12* (2013.01); *B22F 1/054* (2022.01); *F27B 17/0083* (2013.01); *F27D 11/02* (2013.01); *B22F 2301/10* (2013.01); *B22F 2304/054* (2013.01); *F27D 2019/0037* (2013.01)

(58) Field of Classification Search
CPC ..... F27B 3/085; H05B 7/10
USPC .... 373/134, 155, 88, 60, 61, 62, 63, 66, 71, 373/72, 102, 104, 116, 118, 119, 120, 373/122; 219/50, 649; 425/78, 77; 257/467, 419, 466, 522, 528, 619; 428/213, 220, 245, 332, 336, 364, 368, 428/378; 423/447.3, 445; 338/279
See application file for complete search history.

(56) References Cited

U.S. PATENT DOCUMENTS

| | | | | |
|---|---|---|---|---|
| 3,449,117 | A * | 6/1969 | Derham | C22B 4/04 55/315 |
| 3,670,257 | A * | 6/1972 | McMahan | H01S 3/02 372/64 |
| 4,148,964 | A * | 4/1979 | Fedoseev | C04B 35/645 264/332 |
| 4,153,449 | A * | 5/1979 | Greenewald, Jr. | H05B 7/22 420/583 |
| 4,175,022 | A * | 11/1979 | Vadla | C25C 3/085 266/280 |

(Continued)

OTHER PUBLICATIONS

Luther; "Industrial Application of Nanomaterials—Chances and Risks"; Aug. 2004; Future Technologies No. 54; ISSN 1436-5928; Future Technologies Division of VDI Technologiezentrum GmBH, Dusseldorf, Germany.

(Continued)

*Primary Examiner* — Tu B Hoang
*Assistant Examiner* — Vy T Nguyen
(74) *Attorney, Agent, or Firm* — Martin J. Wolff

(57) ABSTRACT

In a system and method for producing submicron sized particles from a substance, the system may comprise a constant current power supply, a furnace for vaporizing the substance having a chamber for containing the substance, and a condensation unit for rapid cooling of the vaporized substance. The furnace may comprise an insulating outer section, a chamber wall, and two electrodes.

18 Claims, 5 Drawing Sheets

(56) References Cited

U.S. PATENT DOCUMENTS

| | | | | | |
|---|---|---|---|---|---|
| 4,247,755 | A * | 1/1981 | Smith, Jr. | H05B 3/62 | 425/405.2 |
| 4,292,276 | A * | 9/1981 | Enomoto | C01B 32/97 | 219/390 |
| 4,366,571 | A * | 12/1982 | Palmquist | C03B 5/0275 | 373/30 |
| 4,888,242 | A * | 12/1989 | Matsuo | C04B 38/02 | 428/184 |
| 2007/0284259 | A1* | 12/2007 | MacLeod | C25C 3/06 | 205/390 |
| 2014/0318312 | A1* | 10/2014 | Deegan | C22B 4/005 | 266/137 |

OTHER PUBLICATIONS

Charitidis et al; "Manufacturing Nanomaterials: from Research to Industry"; Manufacturing Review, Sep. 2014 , 1, 11; EDP Sciences.
"Nanomaterials Handbook";2006; Section 2.4; CRC Press, Taylor and Francis Group, LLC; Boca Raton FL.

* cited by examiner

SYSTEMS AND METHOD FOR THE PRODUCTION OF SUBMICRON SIZED PARTICLES

This U.S. patent application is a Continuation-In-Part from U.S. patent application Ser. No. 17/174,545 filled on Feb. 12, 2021, entitled "Systems and Methods for Separating and Extracting Metals", Ser. No. 16/813,088 filed on Mar. 24, 2020, entitled "System and Method for Heating Materials", which is a Divisional of U.S. patent application Ser. No. 15/433,367 entitled "System and Method for Heating Materials" filed on Jun. 6, 2019, the disclosures of which are incorporated by reference in their entirety.

BACKGROUND

Nanoscale and submicron scale applications employ materials with particle dimensions from 1 to 100 nm at least in one dimension. The unusual physical, chemical, and biological properties of materials in nanoscale particles have created tremendous interest because of how they differ in important ways from the properties of bulk materials and single atoms or molecules. For example, some 10 nm sized metals are 7 times harder than their 100 nm counterparts. Two factors contribute to the material behavior of nanoparticles: a large surface to volume ratio, which makes particles more reactive and affects their electrical properties, and quantum effects that begin to dominate the behavior of matter at the nanoscale and impact the optical, electric, and magnetic behavior of nanoparticles. As a result, nanoscale material finds applications in a wide range of industrial sectors such as in the production of components for the information and communication technology, automotive and aerospace industries, 3d printing, imaging, medicine and biology, agriculture, environment remediation and many others.

Two approaches are used to produce nanoparticles: top-down and bottom-up. The first of these, a top-down process, employs mechanical crushing of source material using milling processes. In a bottom-up process, new structures are built up by chemical processes. The process selection depends on initial material composition and the desired characteristics of the final product. Generally, a top-down process is very energy consuming and as a result is an expensive process. This type of production has limited control on particle size and shape.

There are multiple bottom-up processes including atomic vapor condensation on surfaces and atomic coalescences in liquids. Each of these is limited to certain groups of elements with varying costs. Therefore, what is needed is an environmentally friendly system and process for efficient production of nanoparticles and other submicron sized particles that functions for a broad range of elements and other materials including those with extremely high boiling temperatures.

SUMMARY OF THE INVENTION

The present inventive subject matter is directed to a system and method for the production of submicron sized particles in a wide variety of the chemical elements and compounds, including those with boiling temperatures above 2500° C., by transforming a solid or liquid substance into gas or vapor and subsequent rapid cooling of the vaporized substance to transform it into solid form as nanoparticles or powders comprising submicron sized particles.

A circuit may comprise a constant current power supply electrically coupled to a furnace. By applying a constant current to the furnace, the temperature inside the furnace may be raised high enough to vaporize a substance inside the furnace. The system may also include a condensation unit connected to the furnace by a venting tube for collecting the vaporized substances and solidifying them into submicron sized particles by rapid cooling. Further objects, features, and advantages will be apparent from the following detailed description and taking into consideration the attached figures.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanied drawings in which:

Figure 1:
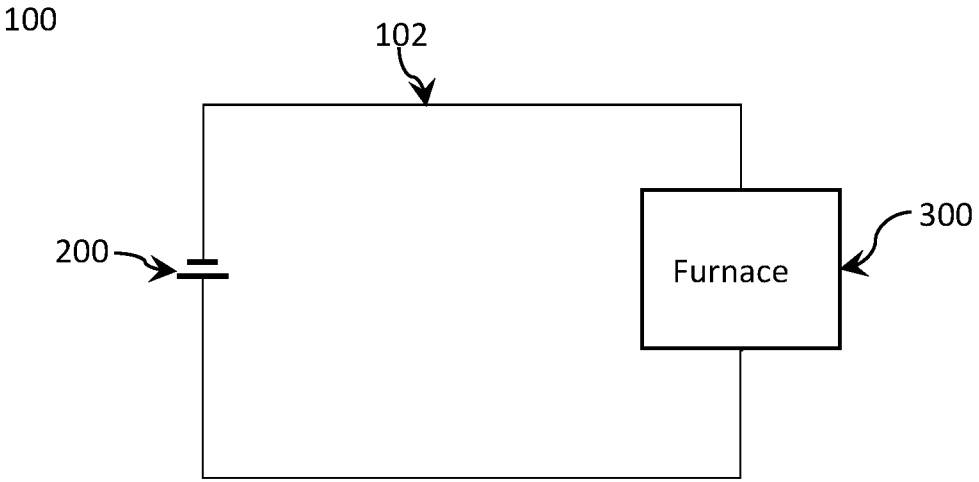
FIG. 1 is a circuit diagram of a system according to an embodiment of the invention.

It will be appreciated that for simplicity and clarity of illustration, elements shown in the drawings have not necessarily been drawn accurately or to scale. For example, the dimensions of some of the elements may be exaggerated relative to other elements for clarity or several physical components included in one functional block or element. Further, where considered appropriate, reference numerals may be repeated among the drawings to indicate corresponding or analogous elements. Moreover, some of the blocks depicted in the drawings may be combined into a single function.

DETAILED DESCRIPTION

In the following description, various aspects of the present invention will be described. For purposes of explanation, specific configurations and details are set forth to provide a thorough understanding of the present invention. However, it will also be apparent to one skilled in the art that the present invention may be practiced without the specific details presented herein. Furthermore, well-known features may be omitted or simplified in order not to obscure the present invention.

As used herein, a substance refers to an element, compound or other material that may be processed by the present invention to be transformed into nanoparticles or other powdered form. Some example substances for which submicron sized and nanometer sized particles are desired include but are not limited to metals and metal oxides including aluminum, iron, silver, gold, titanium, copper, zinc, and certain rare earth metals such as dysprosium, gadolinium, neodymium. Other examples may include carbon, silicon and zirconium and other alloys. The present invention may be used practically for producing most of the metal elements from the periodic table and their alloys in a powder form, the particles of which may have a submicron or smaller, nanometer size.

As described herein, a furnace is a heating device having an internal chamber and connected to an electric power supply to which one or more substances are delivered by batch, conveyor, or other method and configured to achieve operating temperatures to melt, sublimate, or boil desired substances. By adjusting the voltage and current of the electricity applied to the furnace, the temperature inside the furnace can be controlled and set to a specific desired level. Alternatively, such a device may also be referred to as a reactor. The term operating temperature of a furnace refers to the temperature level substantially uniformly distributed throughout the chamber of the furnace, as opposed to a concentrated or localized temperature such as that achieved in or in the vicinity of the arc in a plasma arc furnace or a plasma torch.

The term constant current power supply is a power supply configured to produce a current whose magnitude variation is substantially limited, i.e., constant over a range of voltages and for which the short circuit current is sufficiently limited to avoid damage to the power supply. The current and voltage levels may be configurable for different operating conditions of the furnace. Furthermore, a constant current power supply may supply either a direct current or an alternating current depending on the configurations or embodiments of the invention. In some instances, for which the power supply provides an alternating current, the frequency of the alternating current may be adjustable as well. In some instances of the present invention, a constant alternating current may be preferable over a direct current, as an alternating current may provide additional heating of conductive substances by induction.

As used herein, the process of vaporization is a process by which a substance in solid or liquid state is transformed into a gaseous state. The state change process may be direct, such as in sublimation or boiling or may be in two steps from solid to liquid and then to gas.

The term condensation unit as used herein refers to a device inside of which a vaporized or gaseous substance can be converted by cooling into solid form through deposition or through condensation and subsequent freezing. Such devices are known to those skilled in the art. These devices may comprise a cooling system to enable rapid cooling of a substance injected or otherwise conveyed into the interior of the condensation unit. The cooling system may employ either a liquid or gas as its coolant and a pumping system to circulate the coolant through a closed system of coils or tubes to remove sufficient energy in the form of heat from the substance inside the condensation unit to convert the substance from a gaseous to a solid state. For certain substances, if such cooling is sufficiently rapid, the substance will solidify into submicron sized particles or nanoparticles. Other cooling systems capable of rapid cooling may also be used.

A condensation unit may further comprise a collection plate or other device for collecting nanoparticles or submicron sized particles formed during the condensation process. To facilitate further processing of the particles, the collection plate or device may, in some instances, be detachable from the condensation unit and independently sealed to avoid contamination by air.

In a first illustrative embodiment, the system may comprise a constant current power supply electrically connected to the furnace. The furnace may comprise a chamber for containing a substance, an insulating outer section or layer, a chamber wall having an open-ended annular shape and that is electrically and thermally conductive for resistively heating the chamber in the presence of an electric current flowing through the chamber wall, and two electrodes electrically coupled to the constant current power supply and mechanically, electrically and thermally coupled to the chamber wall that are configured as endcaps of the open-ended annular shape. The chamber wall and the two electrodes may each have a melting temperature higher than the boiling temperature of the substance and may sustain micro-plasma discharges internally to the material of the chamber wall and the material of the two electrodes in the presence of an electric current supplied by the constant current power supply. The chamber wall and two electrodes may be comprised of graphite.

The constant current power supply may be configured to produce a current of constant magnitude over a range of voltage and having a short circuit current, and for which the short circuit current is sufficiently limited to avoid damage to the power supply. The constant current power supply may be configured to provide sufficient power to achieve an operating temperature inside the chamber above the boiling temperature of the substance inside the chamber and for sufficient duration to vaporize all the substance inside the chamber.

This embodiment may further comprise a condensation unit having an interior attached to the chamber wall for solidifying and collecting the vaporized substance, a venting tube connecting the furnace chamber to the interior of the condensation unit for directing vaporized substance to the interior of the condensation unit. The condensation unit may further comprise a condensation chamber inside the condensation unit, an inert gas purging system for purging air from the furnace chamber and the interior of the condensation unit, a liquid cooling system, and a collection device attached to the condensation chamber for collecting the submicron sized particles.

A second illustrative embodiment may include placing a substance inside a chamber of a furnace, the furnace comprising a chamber for containing the substance, an insulating outer section or layer, a chamber wall having an open-ended annular shape and that is electrically and thermally conductive for resistively heating the chamber in the presence of the electric current when flowing through the material of the chamber wall, and two electrodes mechanically, electrically and thermally connected to the chamber wall that are configured as endcaps of the open-ended annular shape. The chamber wall and the two electrodes may each have a melting temperature higher than the boiling temperature of the substance place inside the furnace and may be capable of sustaining micro-plasma discharges internally to the material of the chamber wall and the material of the two electrodes in the presence of an electric current supplied by the constant current power supply. The embodiment may further include supplying an electric current from a constant current power supply electrically coupled to the two electrodes of the furnace. The constant current power supply may be configured to produce a current of constant magnitude over a range of voltage, and having a short circuit current, and for which the short circuit current is sufficiently limited to avoid damage to the power supply, and further configured to provide power at a power level sufficient to raise an operating temperature inside the chamber above the boiling temperature of the substance for a duration to vaporize all of the substance inside the chamber. The embodiment may further include collecting solidified particles of the substance in a condensation unit having an interior and for which the interior of the condensation unit is connected to the furnace chamber by a venting tube. The condensation unit may further comprise a cooling system for rapid cooling of the vaporized substance. The embodiment may also further include purging air from the furnace chamber and interior of the condensation unit with an inert gas purging system prior to supplying electric current from the power supply.

For these and some other embodiments, an alternating current constant current power supply may be used to cause the desired physical processes to happen, although a direct current constant current power supply can be used as well. An alternating current may cause additional inductive heating of the conductive substances placed inside the chamber and, therefore, be preferable.

Furthermore, for this these embodiments, the assembly of the chamber wall and two electrodes, made of the same material, such as graphite for example, mechanically, electrically, and thermally connected to each other may function as a single integrated furnace or reactor, wherein current flow throughout the material of the electrodes and the material of the chamber wall may provide uniform heating of the interior of the chamber.

For some preferred embodiments, if the chamber walls and electrodes of a furnace are fabricated from graphite, for example, the transmission of a high current through the material of the electrodes and through the material of the chamber walls may induce formation of and sustain microplasma discharges internally to the material of the electrodes and the material of the chamber walls, which will, in turn, cause resistive or Joule heating. It is an advantage of the present invention that the heat so generated may be transferred to substances inside the furnace in three ways: first by radiation through empty spaces that may exist inside the chamber, second conductively through contact between the substances and the chamber walls, and third through convection when the substance inside the furnace is either in a liquid or gaseous state. No additional heating sources are required for operation such as needed, for example, when using a crucible to contain substances to be exposed to high temperatures. The distributed nature of the heat generated by the chamber wall and the distributed nature of the current flowing through electrodes and chamber wall may also eliminate the need to cool any components of the furnace during the heating process.

These multiple heat transfer mechanisms and resistive heating from substantially the entire chamber wall may enable more uniform and efficient heating throughout the chamber than for other furnace technologies such as, for example, electric arc or plasma torch furnaces whose heat sources are more localized. Moreover, the stability of the current produced by the constant current power supply may eliminate variations in current density that can cause damage or erode the lifetime of certain components of other furnace technologies which may rely on constant voltage power supplies, while the distributed current flow from the electrodes throughout the chamber walls may eliminate the need for cooling the electrodes that may concentrate electron flow for example through a pointed tip or cooling other parts of a furnace to prevent erosion or other damage. Thus, it is an advantage of the present invention that no cooling system is required for any components of the furnace during heating thereby significantly increasing the energy efficiency of the current invention.

Changing the output current and voltage of the power supply may raise or lower the temperature reached inside the furnace as needed to achieve for different substances or materials corresponding boiling temperatures, while variations in the design of the furnace may serve to improve particle production by boiling and subsequent rapid cooling.

Such a furnace may further include a condensation unit attached on the top of or elsewhere on the surface of the furnace and connected to the furnace chamber by a venting tube or pipe on or near the top of the furnace chamber. The venting tube may also include a valve to isolate the condensation unit from the furnace chamber. The condensation unit may be tapered toward its top end and may include a gas purge system to purge air from the condensation unit and possibly the furnace chamber as well, a cooling system to reduce the temperature of the condensation chamber walls, and a collection plate or other device in the bottom of the condensation unit for collecting nanoparticles or larger sized powders as they form in the condensation chamber. To prevent oxidation of metals inside the condensation unit, the purge gas system may use inert gases such as argon or helium. The collection plate or other device may be sealable and sealed in the presence of these inert gases for removal from the condensation unit and transfer to other sealed containers under pressure with these inert gases or special liquids for particle storage or shipping. Such devices are known to those skilled in the art.

For boiling or sublimation, the temperature inside the furnace chamber may be raised to or above the substance's boiling temperature. The vapor or gas produced may escape from the furnace chamber through the venting tube and may be cooled down and collected in nanoparticle or larger particle form inside the condensation chamber. For some embodiments of present invention, the cooling system may comprise a fast-cooling mechanism that may be used for transforming vaporized substances or material into a solid powder during rapid cooling. The particles of this powder may have a nanometer or larger, submicron scale size. The process of maintaining the temperature and collecting the vapor may continue until all or nearly all substance has completely escaped from the furnace. For embodiments described here, the condensation unit may be isolated from the furnace chamber using the isolation valve of the venting tube while the substance is removed from the collection plate or the collection plate itself is removed. Alternatively, the entire condensation unit may be removed. Furthermore, means for sealing the collection plate under pressure from an inert gas may also be provided. Removal of the contents may, in some instances, take place in a glove box or similar device to preventing contamination by air.

Nanometer scale powders of some materials may be extremely valuable and costly to produce by other existing means.

FIG. 1 shows an embodiment of the present nanoparticle production system. System 100 comprises a circuit 102 including a power supply 200 connected electrically to a furnace 300. Power supply 200 may, for example, comprise an alternating current constant current power supply providing an alternating current at 50 or 60 Hz, although the invention is not limited in this respect. Higher frequencies for the output of power supply 200 may improve microplasma discharge stability and thereby improve the uniformity of heating distribution inside furnace 300. Direct current constant current power supplies may also be employed.

In some embodiments furnace 300 may comprise a furnace for boiling or sublimation of a substance and conversion into nanoparticles or other submicron sized particles. Additionally, the high temperatures achievable in furnace 300 may enable formation of chemical bonds in the substances being heated, the formation of which may not be possible otherwise or as readily available at temperatures below those achievable in furnace 300. For boiling and sublimation, alternating current power sources capable of 1500 amperes of current or higher and a maximum voltage of 90 volts may be used, although the invention is not limited in this respect. Such power sources are available commercially.

Figure 2:
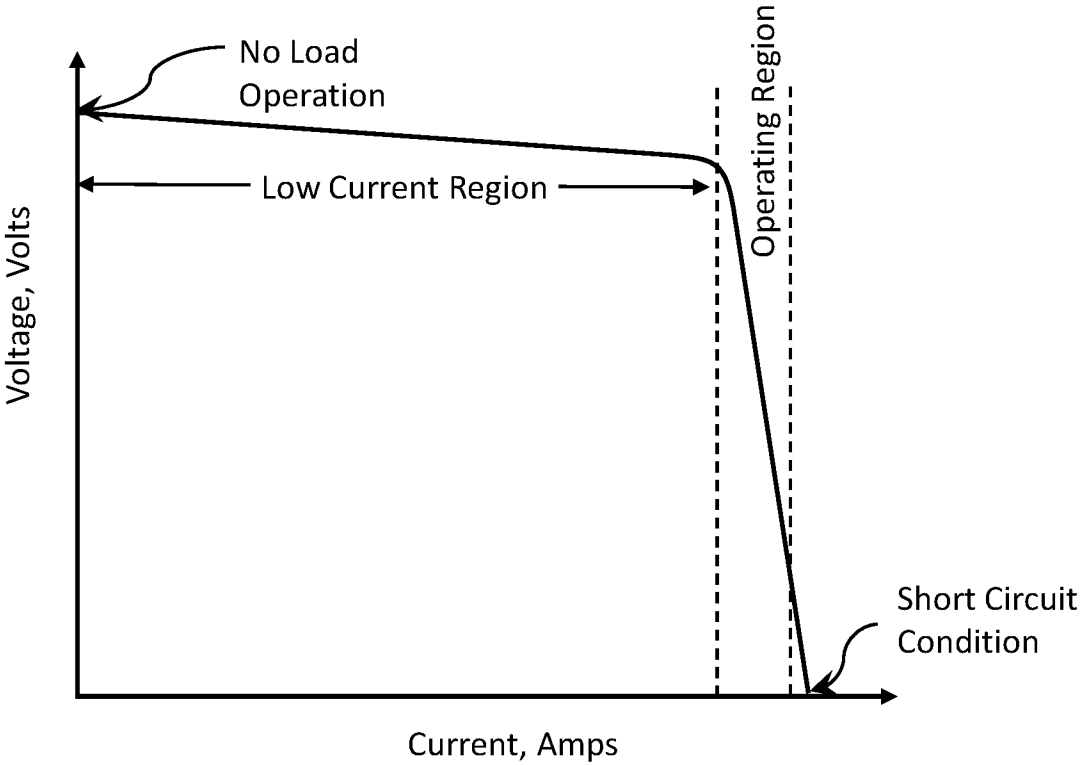
FIG. 2 is a graph showing a representative voltage-current characteristic of a constant current power supply for some embodiments of the invention.

FIG. 2 is a graph that illustrates a typical output voltage-current characteristic of a power supply of the same type as power supply 200 in circuit 102 according to an embodiment of the invention. This constant current power supply may provide for stable operation of the system. The shape of the voltage current curve in FIG. 2 is nearly rectangular, such that for the low current region bounded on a first edge by the no-load operation voltage with no current flowing and at a second edge at which a small decrease in voltage results in a large increase in current; the voltage decreases slightly with increasing current. In the operating region, the current provided by power supply 200 may be relatively constant or steady over a range of decreasing voltages from that at the second edge of the low current region to a low voltage above the zero voltage or the short circuit condition.

A feature of power supply 200 may limit the short circuit current to prevent damaging the power supply. For example, in an embodiment of the present invention, the short circuit current is limited to be no more than approximately 20% higher than the current in the operating region, i.e., at a voltage at or near the short circuit voltage. Constant current power supplies with this characteristic are known in the art and are available commercially, for example as is used in the welding industry.

In some embodiments of the present invention, the voltage and current required for proper operation of the invention may vary according to the boiling and sublimation point of the substance at a given pressure. For example, a higher melting or boiling point for one substance may require a higher operating current and operating voltage than another substance with a lower boiling point. In addition, the voltage and current required for proper operation of the invention may vary according to the construction, capacity, load, and function of furnace 300. Furthermore, power supply 200 may generate a constant high operating current at a relatively low operating voltage. In one embodiment of the present invention, power supply 200 may have a no-load operation voltage of 90V, maximum operating voltage of 44V, and an operating voltage range of 20V to 30V for an operating current of 1200 A to 1500 A at a frequency of 60 Hz. In another embodiment, power supply 200 may have a maximum operating voltage of 8V to 12V with an operating current of 750 A at a frequency of 60 Hz. Operation with this embodiment may produce nanoparticles of aluminum, copper, and zinc. The rate of the rise in temperature inside furnace 300 and duration of power supplied by power supply 200 may be adjusted according to the requirements of the process and may, for some embodiments, be determined experimentally, empirically, or may be derived from the properties of the furnace.

Some embodiments of the present invention may utilize parallel connections of several power sources 200 to enhance current flow through the furnace or increase the frequency of an alternating current power source to provide a sudden increase in current or induction power delivery to the substance processed. Such a sudden spike in power delivery may provide a faster vaporization process.

Figure 3:
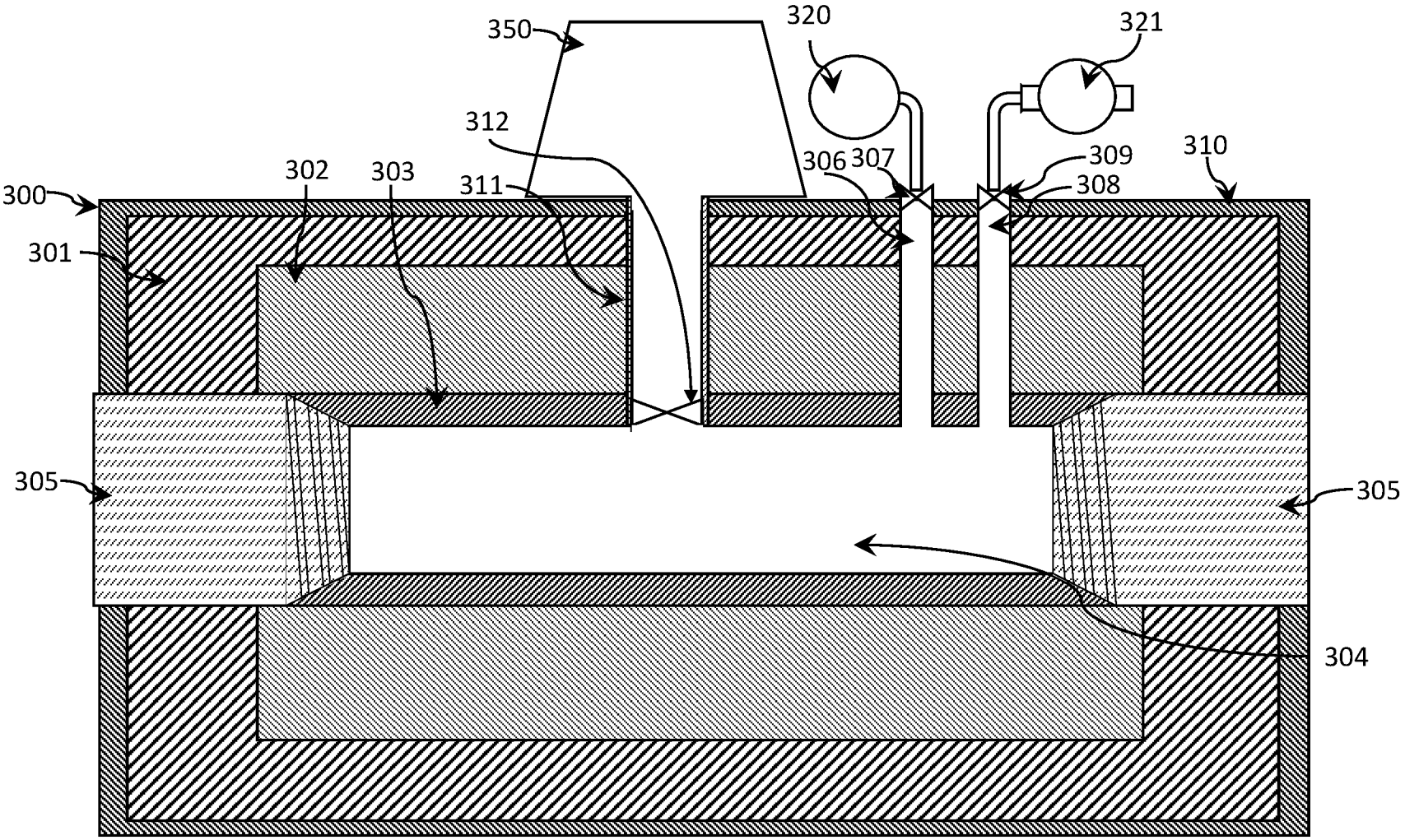
FIG. 3 shows a cross section of a furnace according to an embodiment of the invention.

FIG. 3 shows a cross-section of furnace 300 for some embodiments of the present invention. In the embodiment of FIG. 3, furnace 300 may operate to vaporize or sublimate substances inside the furnace. Furnace 300 may comprise an insulating outer section 301 that surrounds conducting chamber wall 302, sleeve 303, furnace chamber 304, electrodes 305, inert gas supply tube 306, inert gas supply valve 307, gas discharge tube 308, and gas discharge valve 309, enclosure 310, an inert gas supply 320, and a vacuum pump 321. Furnace 300 may additionally comprise vaporization vent 311, vaporization valve 312, and condensation unit 350. Additional elements may be included in furnace 300 as needed to accommodate different uses for furnace 300. Furthermore, in some embodiments for which the operating temperature inside furnace chamber 304 exceeds the melting point of sleeve 303, sleeve 303 may be removed or omitted from the construction of furnace 300. For example, for a sleeve 303 made of tungsten, operation to vaporize lanthanum would necessitate the removal or replacement of the tungsten sleeve 303 with a sleeve having a melting temperature higher than the boiling temperature of lanthanum, 3464° C., in furnace 300.

Insulating outer section 301 may surround chamber wall 302 and may function to assure enough heat retention without undue thermal losses for the vaporization process to occur and may be comprised of one or more insulating materials that thermally insulate chamber wall 302 and furnace chamber 304 from the outside environment. In an embodiment of the present invention, zirconium silicate, chemically $ZrSiO_4$, having a melting temperature between 2100° C. and 2300° C. may be included as one of the ingredients of the insulating material. Zirconium dioxide, chemically $ZrO_2$ may also be included as an ingredient of the insulating material. In some embodiments of the present invention, the insulating material may include a mix comprising 25 to 35 percent silicon dioxide ($SiO_2$) and 75 to 65 percent zirconium dioxide respectively or in approximately a 1 to 3 or 1 to 2 ratio of silicon dioxide to zirconium dioxide along with one or more other materials such that the composition can withstand high temperatures of 2200-2700° C. without degradation or changing states, depending on the relative amounts of $SiO_2$ and $ZrO_2$. Alternatively, for higher temperature applications, some embodiments of insulating outer section 301 may comprise pure zirconium dioxide powder having a melting temperature of 2715° C. Other insulating materials or systems may also be used.

Chamber wall 302 forms the shape of furnace chamber 304 according to the function of furnace 300. In a preferred embodiment, the shape of chamber 304 may be cylindrical with chamber wall 302 having an open-ended annular cylindrical shape although the invention is not limited in this respect. In another embodiment of the present invention, the shape of chamber wall 302 may define a rectangular parallelepiped. Other such shapes that allow for adequate heat retention and distribution, such as a hollow spherical shape, are also possible. To allow for placement or insertion of substances into furnace chamber 304 and removal of processed substances after operation of furnace 300, chamber wall 302 may be separable into 2 or more mated parts. Alternatively, chamber wall 302 may be a single component configured to allow substances to be physically inserted and removed from furnace chamber 304 through the orifices or apertures in which the electrodes are placed. Alternatively, chamber wall 302 may include a sealable orifice to allow for insertion of a substance.

In some embodiments, chamber wall 302 may be wrapped in graphite or carbon felt to retain heat. Such materials having a state change above or near 3000° C., are commercially available.

In some embodiments, chamber wall 302 may be comprised of graphite having an anisotropic structure that may have been formed by a process including isostatic pressure for compaction and or shape forming. For example, the graphite may be extruded, by pressing a fine graphite powder blended with pitch or another binder through a die under pressure. The resulting shape may then be fired, impregnated, fired, and graphitized at a high temperature such as 2000° C.

Alternatively, chamber wall 302 may be comprised of another electrically and thermally conductive material with a state or phase change such as a melting point or sublimation point higher than the highest operating temperature and pressure of furnace 300 and that can support the formation of microplasma discharges internally to the electrically and thermally conductive material with the application of the appropriate voltage and current to electrodes 305. For example, for a graphite cylindrical furnace chamber 304 with a chamber wall 302 having an outer diameter of 24 mm, an inner diameter of 14 mm, a length of 500 mm, and a total graphite mass of 283.5 grams for chamber walls 302 and electrodes 305, an operating voltage of 20V and an alternating current of 1200 amps, 60 Hz will induce the formation of microplasma discharges throughout the graphite of chamber walls 302 and electrodes 305 thereby causing resistive or joule heating and possibly inductive heating of enough magnitude to raise the temperature inside furnace chamber 304 high enough to melt and vaporize a substance inside the reactor. In practice, the highest operating temperature of furnace 300 achieved by an embodiment of the invention has been at least 3422° C., determined by the successful melting of tungsten, although operating temperatures of 3500° C. and higher are also possible.

To prevent a substance from sticking to chamber wall 302 during operation of system 100, some embodiments of the present invention may include a sleeve 303, possibly thin walled, that fits snugly or lines the interior or inside of chamber wall 302 and conforms to the shape of furnace chamber 304. Sleeve 303 may consist of a nonstick, electrically, and thermally conductive material such as tungsten, for example, that prevents substances from attaching to chamber wall 302. Sleeve 303 may also remain in solid form when subjected to the high operating temperatures inside furnace chamber 304.

Two or more electrodes 305 may be electrically connected to the power supply 200 and form a closed circuit together with chamber wall 302. Electrodes 305 extend through enclosure 310 and insulating outer section 301 into chamber wall 302 and may seal furnace chamber 304 when so inserted. In some embodiments, the interior ends of electrodes 305 may be flat or flush with the interior of chamber wall 302, alternatively in other embodiments electrodes 305 may protrude into furnace chamber 304. For embodiments in which sleeve 303 may be present, the ends of electrodes 305 that are to be inserted inside chamber wall 302 may be tapered and may include threading that may be mated to threading in sleeve 303 as in the embodiment of FIG. 3 or to threading in chamber wall 302. Other means for fixing electrodes 305 to chamber wall 302 that can seal furnace chamber 304 and electrically and thermally connect electrodes 305 to chamber wall 302 for furnace operation such as for example an external locking mechanism may also be employed.

In some embodiments for which furnace chamber 304 is cylindrical, electrodes 305 may be shaped as tapered cylindrical endcaps although the invention is not limited in this respect. The shape of electrodes 305 may be configured to fit a different shape for furnace chamber 304 and corresponding different shape for chamber wall 302 as appropriate. Electrodes 305 may consist of graphite as is known in the art, possibly of the same composition as chamber wall 302. Other materials that can withstand the internal temperatures of furnace chamber 304 with no change of state or phase, are electrically conductive, and can internally sustain the formation of internal microplasma discharges may also be employed.

In some embodiments of the present invention after sealing furnace chamber 304, air inside furnace chamber 304 may be replaced or purged with an inert gas such as argon prior to operation to prevent undesirable chemical reactions such as for example oxidation, although the invention is not limited in this respect. For other embodiments, operation of the present invention may be sustainable without purging air inside the furnace chamber. Such purging to provide a non-reactive environment for melting and boiling of the desired substance and the equipment to accomplish it are well known in the art. To accomplish the replacement of air with an inert gas, inert gas supply tube 306 and gas discharge tube 308 may be connected respectively to inert gas supply 320 and vacuum pump 321 as is known in the art. Supply valve 307 and discharge valve 309 may function respectively to isolate inert gas supply 320 and vacuum pump 321 respectively from furnace chamber 304 when the furnace chamber 304 is not being purged. The location, size, and shape of inert gas supply tube 306 and gas discharge tube 308 may vary according to the shape and size of furnace chamber 304. In some embodiments, inert gas supply tube 306 and gas discharge tube 308 may have a circular cross-section, thereby having a cylindrical form although the invention is not limited in this respect. Other tubular shapes are also possible. To replace or purge the air prior to operation, opening supply valve 307 may release a pressurized inert gas into furnace chamber 304. Opening discharge valve 309 may enable air to be exhausted from furnace chamber 304 by vacuum pump 321 when activated. Other purging systems as known in the art may also be employed.

Enclosure 310 may optionally surround insulating outer section 301 and may be sized to contain enough insulating outer section 301 for proper operation of furnace 300 without significant radiative heat loss. Enclosure 310 may also provide additional thermal insulation. In some embodiments, the shape of enclosure 310 may conform to the shape of chamber wall 302, although the invention is not limited in this respect. For example, in one preferred embodiment having a cylindrical chamber wall 302, enclosure 310 may comprise fire-resistant bricks forming all six sides of a rectangular parallelepiped or alternatively five sides with the top optionally open.

The temperature inside furnace chamber 304 may be maintained at or above the boiling temperature of the substance in the chamber for a duration long enough to vaporize completely all or nearly all the substance.

Figure 4:
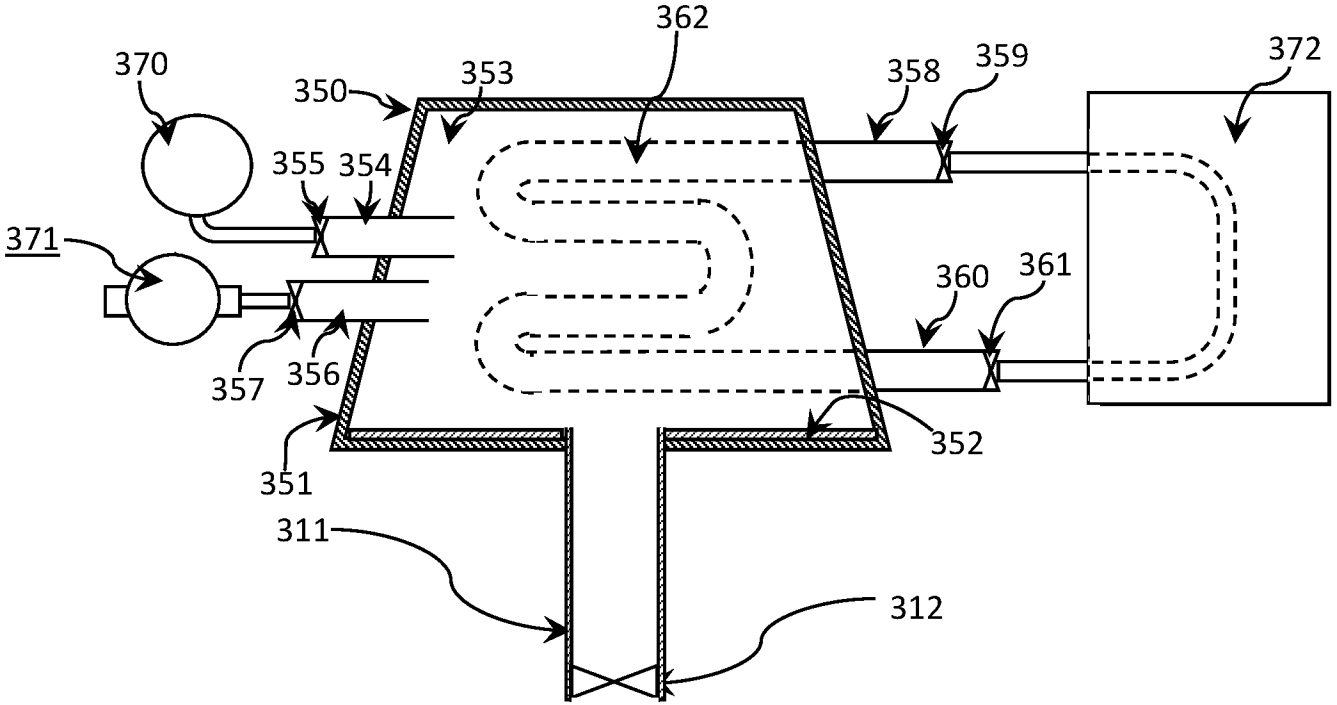
FIG. 4 shows a cross section of a condensation unit according to an embodiment of the invention.

FIG. 4 shows further details of condensation unit 350 as well as vaporization vent 311 and isolation valve 312 according to some embodiments of the present invention. Condensation unit 350 may comprise a condensation chamber wall 351, collection plate 352, condensation chamber 353, condensation chamber inert gas supply tube 354, condensation chamber inert gas supply valve 355, condensation chamber gas discharge tube 356, condensation chamber gas discharge valve 357, liquid coolant supply tube 358, liquid coolant supply valve 359, liquid coolant return tube 360, liquid coolant return valve 361, inert gas supply 370, vacuum pump 371 and cooling system 372.

Vaporization vent 311 may comprise, for example, a graphite tube or other structure made from a solid material with a higher state change temperature than the highest boiling point of the substance. In some embodiments, vaporization vent 311 may be embedded through insulating outer section 301, chamber wall 302, and sleeve 303 into furnace chamber 304 for allowing the vaporized substance to escape. Vaporization vent 311 may have a circular cross-section, thereby having a cylindrical form although the invention is not limited in this respect. Other tubular shapes with different cross-sections are also possible.

When vaporization is substantially or fully complete, power supply 200 may be disengaged, and furnace 300 may be allowed to cool down. Alternatively, in some embodiments a cooling system for furnace 300 as known in the art may be used to accelerate the cooling down of furnace 300.

Depending on the operating state of furnace 300, isolation valve 312 may function to isolate furnace chamber 304 from condensation unit 350 although the invention is not limited in this respect, other mechanisms may be used to isolate furnace chamber 304 from condensation unit 350.

The vaporized or gaseous substance may be captured and collected in condensation unit 350 which may be located above furnace chamber 304 and on top of insulating outer section 301 to allow vaporized substances to rise through vaporization vent 311 and into condensation unit 350. Other locations relative to furnace chamber 304 are also possible. The condensation unit may, in some embodiments, be positioned outside enclosure 310. In some preferred embodiments the shape of condensation unit 350 and correspondingly condensation chamber wall 351 may be a frustum or similar shape with a wider base and tapered in the vertical direction. This tapering may serve to facilitate condensation of gas and collection of solidified particles on collection plate 352. In other embodiments condensation unit 350 may be cylindrical or spherical. Other shapes are also possible. In some preferred embodiments, condensation chamber wall 351 may be fabricated from copper although the invention is not limited in this respect. Other thermally conductive materials capable of withstanding the temperatures inside condensation chamber 353 may also be used. Furthermore, condensation chamber wall 351 may be formed in layers from multiple materials.

Collection plate 352 may be configured to match the shape of the bottom of condensation unit 350 and may rest on or be fixed to the bottom surface of condensation chamber wall 351. In some embodiments, condensation unit 350 may be separable into two or more parts to allow isolation and sealing of, access to, and possibly removal of collection plate 352 for the purpose of collecting the submicron sized or nanometer sized particles that may have accumulated in or on collection plate 352 during operation of furnace 300. Other devices for collecting the particles that can be separated from condensation unit 350 and sealing the collected particles under pressure with an inert gas may also be used.

To facilitate the condensation process, condensation unit 350 may include a fluid filled cooling tube 362 as is known with liquid supply tube 358 and liquid coolant return tube 360 as the input and output for the cooling fluid. Liquid coolant supply valve 359 and liquid coolant return valve 361 may act to isolate cooling tube 362 from cooling system 372. For some embodiments, cooling tube 362 may comprise one or more tubes embedded in condensation chamber wall 351 or on the surface of condensation chamber wall 351 as is known in the art. In a preferred embodiment, the coolant supplied by cooling system 372 may be liquid nitrogen, although other coolants and cooling systems known in the art may also be used. In some embodiments, cooling system 372 may be configured to vary or adjust the temperature of the coolant or the type of coolant used. Moreover, the cooling system may be configured such that the temperature of the coolant is below the freezing temperature of the vaporized substance. Such variations may allow for controlling or varying the size of the particles solidified in condensation unit 350.

In early experiments, condensation unit 350 was comprised of a hollow copper truncated pyramid. Cooling system 372 was an open topped copper box located at the top of the pyramid with no other cooling devices. Tap water was poured into the copper box several times during operation to replenish water as it evaporated. Furnace 300 was a 30×5×5 cm rectangular parallelepiped or cuboid comprised of graphite with an outlet hole on the upper surface. A graphite tube placed into the outlet hole connected the cuboid with the condensation unit placed vertically over the outlet hole on top of the furnace. For this experimental setup, power supply 200 supplied a current of 750 Amps and 10 Volts. The voltage variation throughout the process was limited to 8 to 12 volts. This system produced zinc and copper nanoparticles in 30-60 nm range from metal fragments sized under 10 mm each. The material content was analyzed using a Scanning Electron Microscope (SEM), and the powder particle size was measured with an X-Ray Diffractometer. SEM analysis confirmed 99% purity by weight. X-ray measurements demonstrated a narrow particle size distribution in the range of 40 nm and 30 nm for copper and copper oxide respectively with copper as the initial substance. Similarly, the particle size distribution was 60 nm and 30 nm zinc and zinc oxide respectively. The measured particle width was 3-5 nm for both metals.

Figure 5:
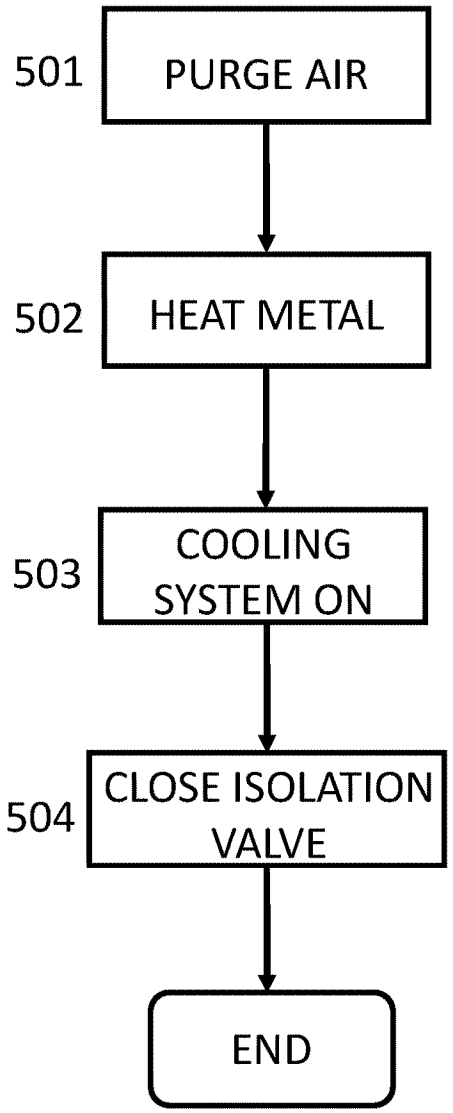
FIG. 5 is a flowchart of a method for the production of submicron sized particles by vaporization and fast cooling according to an embodiment of the invention.

Reference is now made to FIG. 5, which shows a method for vaporization and rapid cooling of a substance to produce submicron sized particles according to a preferred embodiment of the invention. Embodiments of the method may be used by, or may be implemented by, for example, system 100 employing the elements of circuit 102.

It is assumed that the initial operations to place the substance in furnace 300 and the sealing of furnace 300 have already been performed.

In operation 501, inert gas supply valve 307 and gas discharge valve 309 may be opened and inert gas supply 320 and vacuum pump 321 activated to allow an inert gas to enter furnace chamber 304 and possibly condensation chamber 353 thereby replacing the air inside with the inert gas. These valves may then be closed for execution of the next operation. Alternatively, for some embodiments, inert gas supply 370 and vacuum pump 371 may also be used to replace air inside furnace chamber 304 and condensation chamber 353 with isolation valve 312 opened for such purging and optionally being closed after the purging process.

For operation 502, power supply 200 may be activated to apply current to electrodes 305. The current may flow through electrodes 305 and through chamber wall 302 thereby forming microplasma discharges within electrodes 305 and within chamber wall 302 and consequently heating furnace chamber 304 through resistive heating and possibly other heating processes. Unlike in plasma arc furnaces for example, no arc discharge in the interior of furnace chamber 304 is required for the functioning of the present invention.

The voltage and current settings for power supply 200 may be determined by several different parameters including, but not limited to the boiling temperature of the substance to be vaporized, the size and shape of furnace chamber 304, and the type and amount of the substance placed inside furnace chamber 304. Specifically, the internal temperature of furnace chamber 304 may be raised sufficiently high and for sufficient duration to vaporize all the substance placed inside furnace chamber 304.

Once vaporization has started, cooling system 372 is activated in operation 503. Cooling system 372 may stay active until after vaporization is complete. Additionally, isolation valve 312 may be opened at this time if it had been closed prior to activation of cooling system 372. In some embodiments of the present invention, the size of the particles produced in condensation unit 350 may be adjusted by changing the temperature of coolant flowing through cooling system 372. For example, a lower temperature coolant may provide a more rapid cooling process and may produce finer particles than one with a warmer coolant.

Once vaporization and particle production are complete, in operation 504 isolation valve 312 may closed and cooling system 372 may be deactivated. Power supply 200 may also be deactivated at this point. In some embodiments, after cooling and prior to opening, collection plate 352 may be sealed and removed for subsequent processing of its contents. Alternatively, condensation unit 350 may be removed from furnace 300 after being sealed. In other embodiments, furnace 300 may be physically disconnected from power supply 200 for subsequent processing. In all these embodiments, the item containing the nanoparticles or larger powders produced may be placed in a glove box or similar device as is known in the art for isolating its contents from the air. The removal of the substance may then be accomplished without risking contamination.

Other operations or series of operations may be used.

While the invention has been described with respect to a limited number of embodiments, it will be appreciated that many variations, modifications, and other applications of the invention may be made. Embodiments of the present invention may include other apparatuses for performing the operations herein. Such apparatuses may integrate the elements discussed or may comprise alternative components to carry out the same purpose. It will be appreciated by persons skilled in the art that the appended claims are intended to cover all such modifications and changes as fall within the true spirit of the invention.

What is claimed is:

1. A system for producing submicron sized particles from a substance, the system comprising:

a constant current power supply configured to produce a current of constant magnitude over a range of voltage and having a short circuit current, and for which the short circuit current is limited to avoid damage to the constant current power supply, a furnace having a chamber for containing the substance, the furnace comprising an insulating outer section, a chamber wall electrically and thermally conductive for resistively heating the chamber in a presence of an electric current flowing through the chamber wall, and two electrodes electrically coupled to the constant current power supply and mechanically, electrically, and thermally connected to the chamber wall, a condensation unit having an interior for rapid cooling and collecting submicron sized particles of the substance, and and a venting tube connecting the chamber of the furnace to the interior of the condensation unit for directing vaporized substance to the interior of the condensation unit, wherein the chamber wall has an open-ended annular shape, and the two electrodes are endcaps of the open-ended annular shape such that electricity from the constant current power supply flows from the two electrodes to the chamber wall, and wherein each of the chamber wall and the two electrodes are comprised of graphite, and the constant current power supply is configured to provide power to achieve an operating temperature inside the furnace chamber above a boiling temperature of the substance for a duration to vaporize all the substance inside the furnace chamber.

2. The system of claim 1 further comprising an inert gas purging system for purging air from the furnace chamber and the interior of the condensation unit with an inert gas.

3. The system of claim 2 wherein the condensation unit comprises a condensation chamber, the venting tube connects the furnace chamber to the condensation chamber, a cooling system, and a collection device connected to the condensation chamber for collecting the the submicron sized particles.

4. The system of claim 3 further comprising an isolation valve and the condensation unit is detachable from the venting tube.

5. The system of claim 4 wherein the collection device is configured to be sealed and isolated from the condensation chamber after production of the submicron sized particles is complete and is detachable from the condensation chamber.

6. The system of claim 5 wherein the cooling system comprises a series of coils containing a coolant having a temperature below a freezing point of the substance and wherein the temperature of the coolant can be adjusted to vary the size of submicron sized particles produced.

7. The system of claim 6 wherein the constant current power supply is an alternating current constant current power supply.

8. The system of claim 7 wherein the collection device is a collection plate.

9. The system of claim 8 further comprising a tungsten sleeve to fit snugly inside the chamber wall.

10. A method for producing submicron sized particles from a substance, the method comprising:

placing the substance having a boiling temperature inside a chamber of a furnace, the furnace comprising an insulating outer section, a chamber wall electrically and thermally conductive for resistively heating the chamber in a presence of an electric current flowing through a material of the chamber wall, and two electrodes mechanically, electrically, and thermally connected to the chamber wall, supplying the electric current from a constant current power supply electrically coupled to the two electrodes at a power level to raise an operating temperature inside the furnace chamber above the boiling temperature of the substance inside the furnace chamber and for a duration long enough to vaporize all of the substance, the constant current power supply configured to produce a current of constant magnitude over a range of voltage and having a short circuit current, and for which the short circuit current is limited to avoid damage to the constant current power supply, and collecting submicron sized particles of the substance inside a condensation unit, wherein the condensation unit having an interior for rapid cooling of the substance, wherein the chamber wall has an open-ended annular shape, and the two electrodes are endcaps of the open-ended annular shape such that electricity from the constant current power supply flows from the two electrodes to the chamber wall, and wherein each of the chamber wall and the two electrodes are comprised of graphite, and the interior of the condensation unit is connected to the furnace chamber by a venting tube.

11. The method of claim 10 wherein the furnace further comprises an inert gas purging system for purging air from the chamber and the method further comprises the step of purging air from the chamber prior to supplying the electric current from the current constant current power supply.

12. The method of claim 11 wherein the condensation unit comprises a condensation chamber, the venting tube connects the furnace chamber to the condensation chamber, a cooling system, and a collection device connected to the condensation chamber for collecting the solidified substance.

13. The method of claim 12 wherein the condensation unit further comprises an isolation valve and is detachable from the venting tube and the method further comprises closing the isolation valve after collecting the submicron sized particles.

14. The method of claim 13 wherein the collection device is configured to be sealed and isolated from the condensation chamber and is detachable from the furnace, and the method further comprises isolating the collection device after production of the submicron sized particles is complete.

15. The method of claim 14 wherein the cooling system comprises a series of coils containing a coolant having a temperature below a freezing point of the substance and wherein the temperature of the coolant can be adjusted to vary the size of the submicron sized particles produced.

16. The method of claim 15 wherein the constant current power supply is an alternating current constant current power supply.

17. The method of claim 16 wherein the collection device is a collection plate.

18. The method of claim 17 wherein the furnace further comprises a tungsten sleeve fitting snugly inside the chamber wall.

* * * * *